United States Patent [19]

Marsh

[11] Patent Number: 5,039,412

[45] Date of Patent: Aug. 13, 1991

[54] WIRE WITH GUIDE BELTS FOR A PULP THICKENER

[75] Inventor: Paul G. Marsh, Hamilton, Ohio

[73] Assignee: The Black Clawson Company, Middletown, Ohio

[21] Appl. No.: 517,978

[22] Filed: Apr. 27, 1990

Related U.S. Application Data

[63] Continuation of Ser. No. 229,393, Aug. 8, 1988, abandoned, which is a continuation-in-part of Ser. No. 193,026, May 12, 1988, abandoned.

[51] Int. Cl.[5] ..... B01D 33/04

[52] U.S. Cl. ..... 210/401; 210/407; 210/499; 209/307; 209/400; 209/401; 209/403; 198/699; 198/957; 162/348; 162/358; 162/DIG. 1

[58] Field of Search ..... 210/401, 407, 499; 209/307, 403, 400, 401; 198/699, 957; 162/55, 358, 348, DIG. 1

[56] References Cited

U.S. PATENT DOCUMENTS

| | | | |
|---|---|---|---|
| 864,828 | 9/1907 | Callow | 209/307 |
| 2,963,161 | 12/1960 | Holland | 210/401 |
| 3,143,502 | 8/1964 | Krynski | 210/401 |
| 3,356,224 | 12/1967 | Orr | 210/401 |
| 3,825,125 | 7/1974 | Peterson et al. | 210/401 |
| 4,722,793 | 2/1988 | Seifert et al. | 210/401 |

*Primary Examiner*—David A. Simmons
*Assistant Examiner*—Thi Dang
*Attorney, Agent, or Firm*—Biebel & French

[57] ABSTRACT

A high speed stock thickener has a foraminous endless wire. The stock thickener is of the type in which an open mesh endless wire is trained over a pair of rolls and paper stock to be thickened is applied between the wire and the rolls and is carried on an inside surface of the wire for dewatering, particularly at the regions where the stock is carried between the wire and a roll. The improved wire is formed with a width greater than that of the rolls with a marginal edge of the wire extending beyond the face of the rolls. A guide belt is attached at each of the marginal edges of the wire and runs with a side wall in engagement with the end of the adjacent roll. The guide belts are attached to the wire by an adhesive bond between the backs of the belts and the adjacent wire surfaces, and by a continous thread which is sewn through each belt from the bottom of the belt and through the back thereof and into the wire.

1 Claim, 3 Drawing Sheets

30
115
116

77
121
120
30

77
30
126
125

95
80
85
80
30

102
101
100
30
77

111
110
30

30
80
70
81
77

30
87
88
80
86
88
85
77
87

30
90
85
92
92
77

WIRE WITH GUIDE BELTS FOR A PULP THICKENER

REFERENCE TO RELATED APPLICATION

This is a continuation of Ser. No. 229,393 filed Aug. 8, 1988, now abandoned, which is a continuation-in-part of my application Ser. No. 193,026, filed May 12, 1988, now abandoned.

BACKGROUND OF THE INVENTION

The present invention has particular relation to the apparatus for thickening pulp and paper stock shown in Seifert et al U.S. Pat. No. 4,722,793, issued Feb. 2, 1988 to the assignee of this application. The apparatus disclosed in that patent comprises, as its major component, a pair of liquid-impervious rolls rotatably mounted in spaced relation on substantially horizontal axes. An endless wire is trained around these rolls in wrapping relation with a substantial portion of the surfaces of each thereof, and means are provided for driving one of the rolls to cause this wire to travel around the rolls while cooperating therewith to define a space mounted by the rolls and the opposed upper and lower runs of the wire.

A headbox is mounted in this space and includes an outlet for the pulp suspension to be thickened which is discharged into the wedge zone defined by one of the rolls and the portion of the wire approaching that roll, whereby this pulp suspension is trapped between the wire and the roll. The rolls are driven at a speed effecting the development of centrifugal force causing liquid to be expressed from between the wire and rolls with the resulting thickening of the pulp carried on the inner surface of the wire, and means are provided to collect and remove this thickened pulp.

The above patent also discloses that in order to guide the wire so that it will continue to travel in a path perpendicular to the axes of the two rolls, the wire may be provided along one or both edges of its inner surface with a strip, e.g. a V-belt, which fits in a peripheral groove in each of the rolls. In the practical development of the apparatus of that patent, however, considerable difficulty was encountered in securing this guiding strip to the wire in a manner which would prevent its separation from the wire under the stresses of use, particularly at the relatively high speeds contemplated for the apparatus, namely speeds as high as 3,000 feet per minute. More specifically, while it would be presumed that this would not be a problem in view of the improvements in recent years in the technology of adhesives, no adhesive could be found for securing such a guiding strip to a woven wire which would hold up for a satisfactory period even under prototype laboratory testing conditions.

SUMMARY OF THE INVENTION

In accordance with the invention, it was discovered that this problem could be successfully solved by using as the guide strip, a belt of narrow cross section, e.g. a V-belt, and by fastening this belt to the wire loop by mechanical means, as by stitching with strong thread, e.g. monofilament fish line, or wire, or by riveting. This stitched connection may also be reinforced by a layer of adhesive which impregnates the wire overlying the belt, and/or by a strip of reinforcing material, e.g. rubber, which is on the opposite side of the wire and is stitched to the belt through the wire.

In the above patent, the guide strips are shown as engaging in complementary grooves near the ends of the roll faces, and the present invention can be practiced in that manner. Preferably, however, the width of the wire is such that with two guide belts stitched thereto adjacent its opposite edges, they will overhang the ends of the rolls rather than engaging in grooves in the roll surfaces. With this construction and arrangement, all of the wire which wraps each roll is able to take part in the pulp carrying and dewatering operation, and this arrangement also makes it unnecessary to fabricate guide grooves in the rolls. In addition, the adhesive preferably extends into the adjacent outer edge portion of the wire, and it provides effective protection against fraying thereof.

In another embodiment of the invention, which provides for use of the wire with either side outermost, one or two belts are provided on each surface of the wire to guide the wire with either side outermost. Preferably, these belts are in line with each other on opposite sides of the wire and are stitched together through the wire.

The objectives of the invention, and additional means by which they are carried out, are discussed in more detail in the description of the preferred embodiments which follows. In this connection, it should be noted that although the invention was developed to solve a problem with a particular form of paper stock thickener, it is applicable to wires used on other forms of paper machinery, including Fourdrinier paper machines and pulp washing machine as shown in Ericsson U.S. Pat. No. 4,154,644.

DESCRIPTION OF THE PREFERRED EMBODIMENTS

Figure 1:
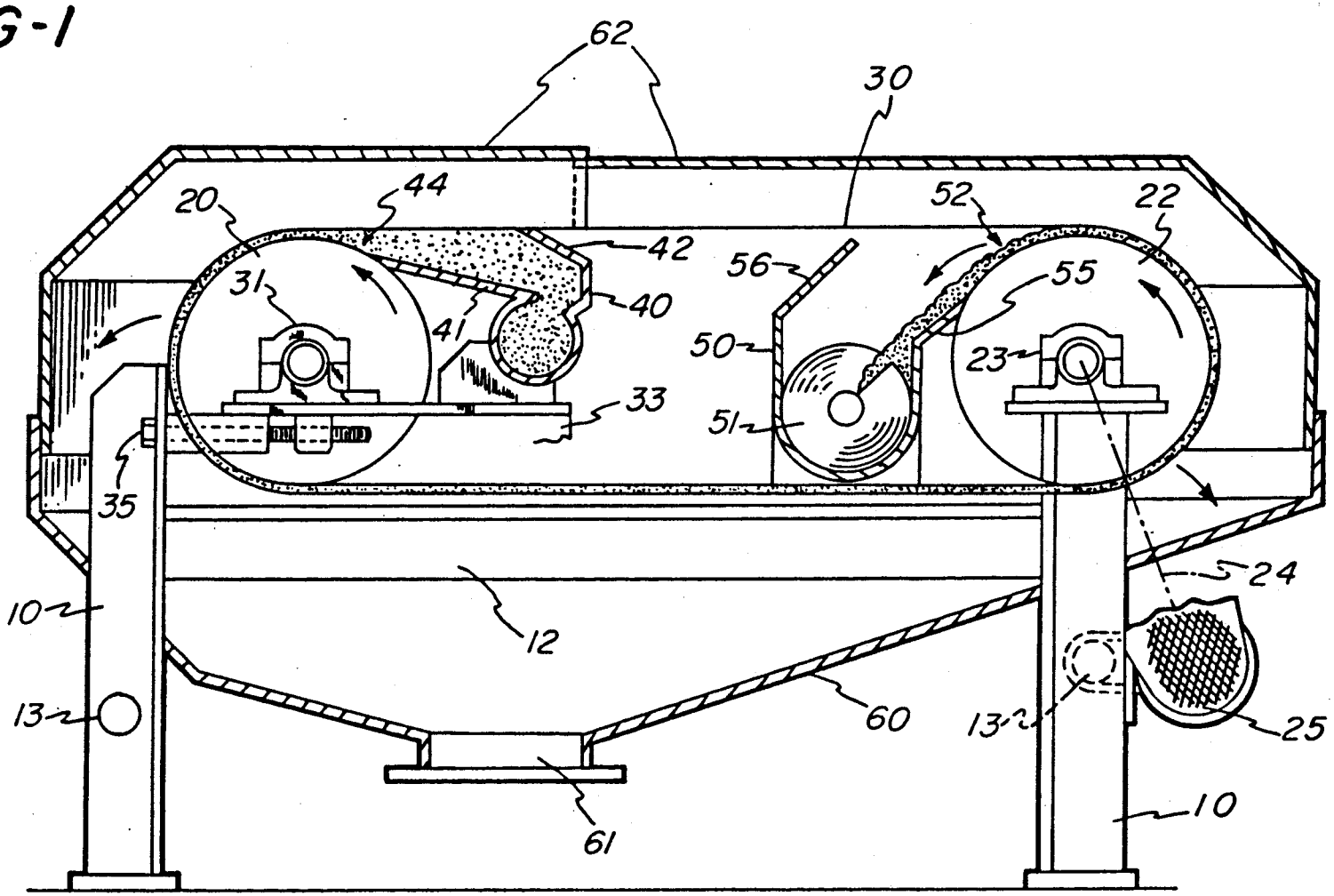
FIG. 1 is a somewhat diagrammatic side view, partly in section, of thickening apparatus with which the present invention is used.
Figure 2:
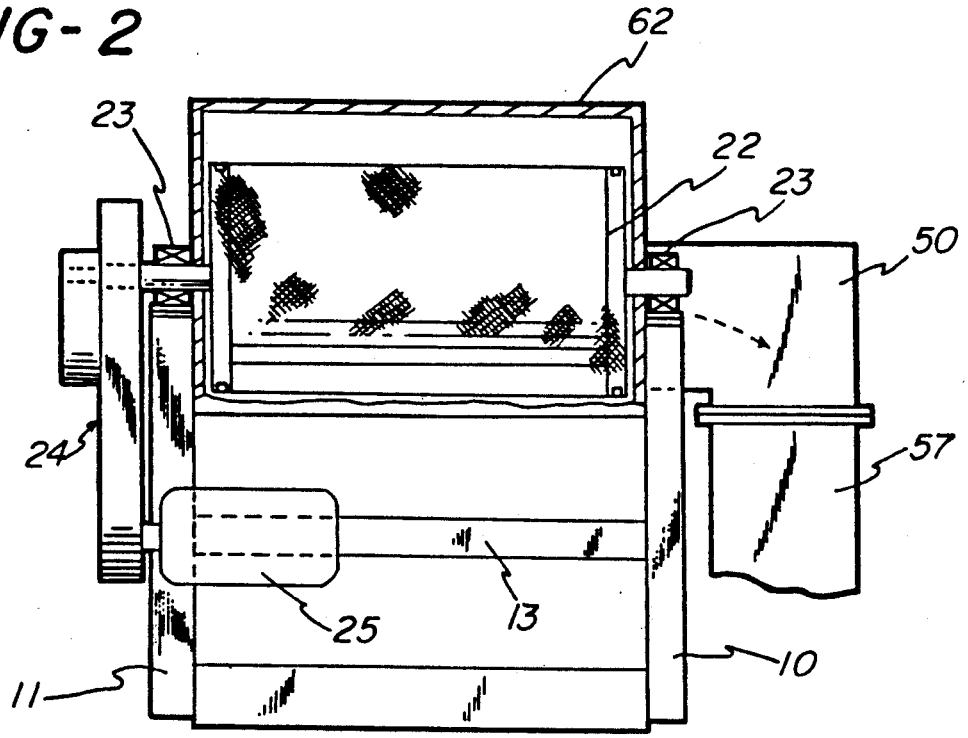
FIG. 2 is an end view looking from right to left in FIG. 1 and partly broken away in section.

FIGS. 1–2 illustrate the principal structure of the thickening apparatus described and claimed in U.S. Pat. No. 4,722,793. It includes a relatively simple frame comprising two columns 10 and 11 on each side connected by side beams 12 and suitable cross braces 13. The two large rolls 20 and 22 which are the major operating elements of this apparatus are mounted adjacent opposite ends of the frame, the roll 22 being shown as mounted by pillow block bearings 23 on the tops of columns 10 and 11. This roll 22 is a driven roll, through the belt drive indicated generally at 24 by a motor 25 mounted on the cross brace 13 between the columns 10 and 11. The rolls 20 and 22 should have liquid-impervious outer surfaces, but preferably these surfaces should be grooved, as described in the above patent and as indicated by the helical grooves 26 in FIG. 3.

An endless loop of woven foraminous "wire" 30 is trained around the rolls 20 and 22 and defines therewith a space in which the other operating parts of the apparatus are located. Preferably the wire 30 will consist of any plastic material currently used for paper machine wires, e.g. polyester. Roll 20 has an adjustable mounting on the frame which includes means for tensioning the wire, each of the journals of the roll 20 being mounted by a pillow block 31 on a base 33 which is in turn mounted for sliding movement on the side beam 12. Means such as a pair of jack screws 35 connected between bases 33 and the adjacent columns 10 and 11 cause and control this movement to effect corresponding control of the tension in wire 30.

A headbox 40 is mounted on the same base members 33 as the roll 20 so that it maintains a fixed spacing with respect to roll 20. This headbox is shown as of an open type including lower and upper walls 41 and 42 which extend upwardly to define a spout through which stock is discharged into the wedge zone 44 defined by the upper run of wire 30 approaching roll 20 and the surface of the roll itself. The stock to be thickened is fed to the headbox by any convenient feed line (not shown) from the usual stock supply pump (not shown).

At the other end of the space defined by the upper and lower runs of the wire 30 and the rolls 20 and 22 is a trough 50 having a screw conveyor 51 mounted in the bottom thereof for receiving thickened pulp from the surface of roll 22 in the wedge zone 52 defined by the roll surface and the upper run of wire 30 leaving this roll. The trough 50 includes a doctor 55 extending along its downstream edge which removes the thickened pump from the surface of roll 22. An inclined wall 56 along the front edge of trough 50 prevents this pulp from being thrown beyond the trough, and the screw 51 forces the accumulated pulp to a chute 57 at the back of the machine which leads to the next station in the system.

In the operation of this apparatus, the pulp suspension to be thickened is constantly supplied to the wedge zone 44 from the headbox 40, and since a substantial volume of water will be forced through the wire before the wire reaches the roll 20, the resulting partially dewatered pulp is trapped between the wire 30 and the portion of the surface of roll 20 wrapped thereby. Proper control of wire tension contributes to the effectiveness of the initial dewatering of the suspension in the wedge zone 44 as the pulp travels therefrom around the surface of roll 20.

More specifically, it is desirable that the wire tension not be so high as to make it difficult for the preliminarily thickened suspension to enter the space between the wire and the surface of roll 20. Thus if the wire tension is comparatively low, e.g. 1–40 lbs. per linear inch, the pulp which has been subjected to initial dewatering as it approaches the small end of the wedge zone 44 will be more readily trapped between the wire and the roll 20 than if the wire is very tight.

The primary action of the wire is therefore to serve as a filter medium that holds the fiber on its inner surface against the action of centrifugal force, which is the major factor causing dewatering of the retained pulp at the speeds contemplated by the invention, e.g. wire speeds in the range of 2100–3000 feet per minute using rolls 20 and 22 which are 24 inches in diameter. The white water expressed in this manner through the wire is thrown into a trough 60 which extends under both rolls 20 and 22 and is provided with a drain outlet 61. A two-piece hood 62 is mounted on the frame above the apparatus as a whole, and it fits into the top of the trough 60 so that any water hitting the inner surface of this hood will drip therefrom into the trough.

It is important, particularly in view of the high wire speeds contemplated by the invention, that the wire 30 be continuously maintained in guided relation with the rolls 20 and 22 such that it travels along a course perpendicular to the axes of these two rolls. In the preferred embodiment of the present invention, this guiding action is achieved by means of a pair of conventional V-belts 70 adjacent opposite side edges of the inside surface of the wire 30.

Figure 3:
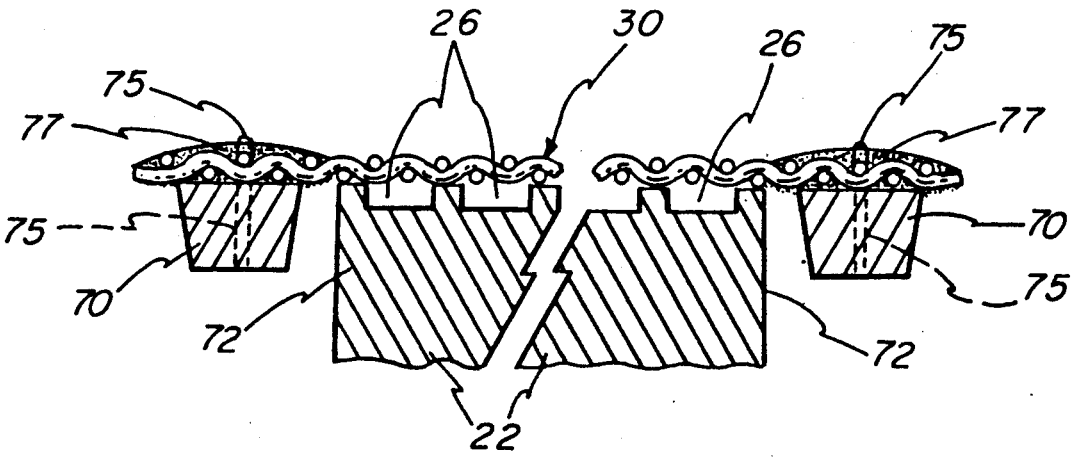
FIG. 3 is an enlarged fragment of FIG. 2.

While these belts could fit into grooves in the surfaces of rolls 20 and 22, as disclosed in U.S. Pat. No. 4,722,793, preferred results have been obtained with the wire sufficiently wider than the axial dimensions of rolls 20 and 22 to locate these belts in overhanging relation with the ends of the faces of rolls 20 and 22, as shown in FIG. 3, so that each of these roll ends acts as a shoulder 72 which will engage the inner side surface of the adjacent belt 70 if the wire should drift to one side or the other. A single belt could be used, but in that case, there should be complementary grooves in the rolls 20 and 22.

In the practical development of the thickening apparatus shown in FIG. 1, difficulty was encountered in effecting a connection between the belts 70 and the wire 30 which could successfully withstand the stresses applied thereto in test operations. This problem was solved by the discovery that a secure connection, which would last as long as the useful life of the wire itself, could be obtained by literally stitching each belt 70 to the wire 30, as indicated at 75 in FIG. 3. While the configuration of the belt itself is not critical, preferred results have been obtained with a V-belt of the configuration shown in FIG. 3, which is formed of polyvinyl chloride and has a radial dimension of 0.625 inch and a thickness ranging from 0.875 inch to 0.675 inch.

It is important that the stitching 75 comprise a thread or line of sufficient strength, and particularly toughness, to withstand the repeated bending and flexing of the belt 70 as they travel around the rolls 20 and 22, and the thread must also be highly water resistant. From these standpoints, satisfactory results have been obtained using woven nylon 50 lb. test fishing line, but other types of thread or wire of comparable mechanical attributes could be used, as well as other forms of mechanical connections, such as rivets.

In addition to the stitching 75, it has been found desirable to provide a glued connection between each belt 70 and the wire 30. More specifically, before attaching a belt to the wire, the outer edge portion of the wire is impregnated with urethane adhesive over a band approximately 1.5 inches wide which extends to and includes the outer edge of the wire, as indicated at 77 in FIG. 3.

After this adhesive material has dried, the wide edge of the belt 70 is glued thereto, preferably with an adhesive which will chemically bond the belt with the adhesive, impregnated strip of the wire. Adhesives found satisfactory for this purpose are those sold under the tradename "PU Adhesive" by Sigling America, Inc., Englewood, N.J., and under the tradename "Rema S. C.-2000" by Rema Division of Remaco, Northvale, N.J., in each case using the hardener recommended by the manufacturer with the adhesive. The joint is then completed by stitching the belt to the wire, as by means of a sewing machine such as is used in shoe-making operations.

In order to practice the invention as described above, it is of course necessary that the wire 30 be sufficiently wider than the axial length of the faces of rolls 20 and 22 to provide overhanging marginal portions of the wire at both ends of the rolls which will carry the belts 70. With a belt of the cross sectional dimensions noted above, satisfactory results have been obtained with the wire 2.75 inches wider than the length of each of the rolls, and with a strip of wire 0.25 inch wide extending beyond each belt, thereby providing a total clearance of 0.50 inch for each of the rolls between the pair of belts 70. Thus so long as the wire runs in a straight line, there may be no contact between either roll and either of the belts 70, but if the belt should wander slightly to one side or the other, engagement between the end of a roll and the inclined adjacent surface of one of the belts 70 will result in a camming action causing the belt to return to substantially centered relation with both rolls.

The combined glued and stitched connection between each belt 70 and the wire 30 has been found to last at least as long as the useful life of the wire itself, even under the high speed operating conditions of the thickener of the invention. In addition, with the strips of adhesive 77 extending to the outer edges of the wire, they have been found to strengthen and protect these portions of the wire from fraying in use and thus to contribute to extending the useful life of each wire.

FIGS. 4–12 illustrate modified constructions which embody the invention as described above. Thus in FIG. 4, a strip 80 of reinforcing material, which may be of the same elastomeric material as the belt 70 but somewhat greater width, is positioned on the opposite side of the wire 30 from the belt 70. The stitching 81 traverses both the belt 70 and the reinforcing strip 80 to secure these two elements together through the wire. The junction between these parts may also be reinforced by impregnating the portion of the wire underlying the strip 80 with glue, as indicated at 77.

Figures 4, 5, 6, 7, 8, 9, 10, 11, 12:
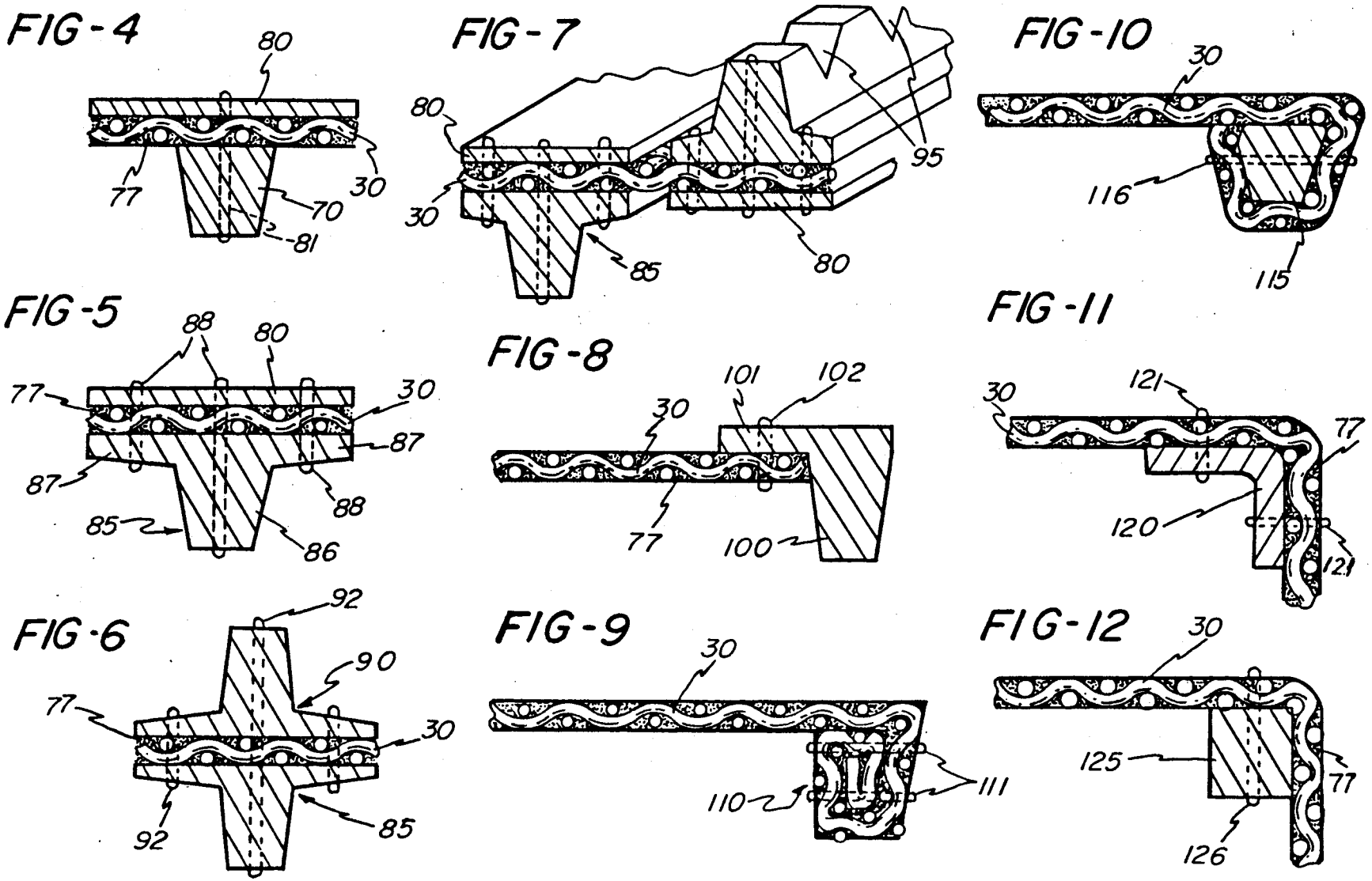
FIGS. 4 and 5 are enlarged fragmentary sections illustrating modifications of the construction shown in FIG. 3.
FIG. 6 is a view similar to FIG. 5 showing an embodiment of the invention wherein a guide belt is located on each side of the wire.
FIG. 7 is a perspective view similar to FIG. 6 showing a variation in the location of the guide belts on both sides of the wire.
FIGS. 8–12 are views similar to FIG. 4 showing other embodiments of the invention.

The construction shown in FIG. 5 is similar to that in FIG. 4 except that the guide belt 85 includes a V-belt section 86 and marginal flanges 87 which cooperate with the wider portion of the V-section 86 to provide an increased area of contact with the wire 30. In addition, a strip 80 of reinforcing material of the same width as the maximum width of belt 85 is positioned on the opposite side of the wire 30 as in FIG. 4. The stitching 88 traverses both the V-section 86 of belt 85 and its side flanges portions as well as the reinforcing strip 80 and the wire. As in FIG. 4, it is desirable to reinforce the interconnection between these parts by impregnating the portion of the wire between the strip 80 and belt 85 with glue.

FIG. 6 shows the application of the invention to a wire 30 which may be used with either side outermost. For this purpose, a second belt 90 of the same cross sectional configuration as the belt 85 is placed on the other side of the wire from the belt 85, and the two belts are fastened to each other and the wire by stitching 92 which traverses all three elements as shown. The interconnection between the two belts may also be reinforced by impregnating the portion of wire therebetween with glue.

FIG. 7 illustrates a modification of the invention wherein guide belts 85 and 90 are provided on both sides of the wire but in offset relation, and with the connection between each of these belts and the wire provided with a reinforcing strip 80 as described in connection with FIGS. 4 and 5. FIG. 7 also illustrates both of belts 85 and 90 as provided with multiple V-shaped slits 95 for relieving the tension and compression forces which affect the belts during use. More specifically, it will be apparent that with belts on both sides of the wire loop, the peripheral dimension of the belt on the outside of the wire will be greater than that of the inside belt, but this relationship will be reversed when the wire is turned inside out. The slits 95 cooperate with the elastomeric properties of the belts to compensate for these dimensional differences, and similar slits should be provided in the belts 85 and 90 in FIG. 6.

FIG. 8 shows a form of the invention wherein the guiding V-belt 100 includes a flange portion 101 on only one side thereof, and the belt is secured to the wire 30 by superimposing the flange 101 on a marginal strip of the wire 30 and securing these overlying layers together by stitching 102, preferably reinforced by glue impregnating the portion of the wire in contact with belt flange 101. It will be understood that this construction is duplicated at the other side of the wire.

In FIG. 9, the wire 30 is provided at each side with a guide belt 110 formed by rolling a marginal strip of wire on itself into the form of a V-belt. This rolled portion of the wire is secured together by means of stitching 111, and its formation may also be aided by a center core, preferably of elastomeric material and V-shape in section.

FIG. 10 shows a form of the invention similar to that in FIG. 9 except that the core 115 is a V-belt, and it is secured to the edge of the wire 30 by wrapping it in a marginal strip of the wire, with the resulting assembly secured together and to the wire by stitching 116.

FIGS. 11 and 12 show two other forms of guiding belt which may be secured along each edge of the wire 30. In FIG. 11, the guiding belt 120 is of right angled form, and it is secured to the edge of the wire by folding a marginal strip of wire around it and by stitching 121 as shown. Preferably the overlying strip of wire will be impregnated with glue at the time of assembly. The guide belt 125 in FIG. 12 is of rectangular section and is similarly partially enclosed by a strip of wire 30 to which it is secured by stitching 126, again preferably with the aid of adhesive impregnating that portion of the wire which is contact with belt 125.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. In a high speed stock thickener for papermaker's paper stock in which an open mesh endless wire is trained over at least two rolls, in which said rolls have a predetermined length between their axial ends and in which said wire is of a width greater than said predetermined length to provide marginal edges which extend beyond said roll axial ends, said thickener including means for applying such paper stock between said wire and said rolls so that said paper stock is carried on an inside surface of said wire for dewatering at the regions where said stock is carried between said wire and a roll, and in which said rolls are formed with roll shoulders at each of their said axial ends defining end faces for coaction with a guide belt on said wire, the combination of means for maintaining said wire in guided relation on said rolls comprising:

a pair of V-shaped guide belts, each attached to one of said wire marginal edges, each of said belts having a back forming a mounting surface, a side wall positioned in immediate adjacent relation to one of said end faces of said rolls for engagement with one of said roll shoulders, and a bottom, first fastening means attaching each said belt at the back thereof to said wire, incuding an adhesive bond between said back and the adjacent wire surface, said adhesive bond including glue which penetrates the open wire mesh and forms a bond between the belt and the wire, and second fastening means joining each said belt to said wire including a continuous thread sewn through said belt from said bottom through the back thereof and into said wire, said thread extending the length of the belt.

* * * * *